United States Patent [19]

Kuda et al.

[11] 4,143,681

[45] Mar. 13, 1979

[54] APPARATUS FOR DISTRIBUTING PRESSURIZED FLUID TO A MULTI-ELEMENT WEFT INSERTER

[75] Inventors: Vladimír Kuda, Blazovice; Miroslav Buček, Brnenske Ivanovice, both of Czechoslovakia

[73] Assignee: Vyzkumny a vyvojovy ustav Zavodu vseobecneho strojirenstyl, Brno, Czechoslovakia

[21] Appl. No.: 728,771

[30] Foreign Application Priority Data

Oct. 1, 1975 [CS] Czechoslovakia ..... 6620-75

[22] Filed: Oct. 1, 1976

[51] Int. Cl.[2] ..... D03D 47/30

[52] U.S. Cl. ..... 139/435

[58] Field of Search ..... 139/435, 452; 226/97

[56] References Cited

U.S. PATENT DOCUMENTS

| | | | |
|---|---|---|---|
| 3,705,608 | 12/1972 | Vermuelen | 139/435 |
| 3,821,972 | 7/1974 | Svaty et al. | 139/435 |

FOREIGN PATENT DOCUMENTS

| | | | |
|---|---|---|---|
| 733791 | 5/1966 | Canada | 139/435 |
| 2344717 | 5/1975 | Fed. Rep. of Germany | 139/435 |
| 409812 | 10/1966 | Switzerland | 139/435 |

*Primary Examiner*—Henry S. Jaudon

[57] ABSTRACT

An improved distributing arrangement for successively coupling pulses of pressurized fluid through a succession of active weft-propelling auxiliary elements distributed along the shed of a fluid-jet loom is described. A pressurized fluid distributing cylinder supported for rotation on a portion of the machine frame has a plurality of peripheral openings which extend in axial and circumferentially spaced relation along the cylinder. A plurality of rotary valves are associated with each of the openings, with each valve having a first apertured portion carried by the cylinder and a second cooperating apertured portion carried by the frame and urged against the first portion. During a rotation of the cylinder in synchronism with the rotation of the main machine shaft, the conduits in both portions of each valve means come into registration to provide communication between the interior of the associated portion of the cylinder and one of the active elements of the weft insertion section. A baffle or plug member may be disposed within the cylinder to divide the cylinder into separate fluid-feeding regions for the main weft insertion nozzle and the auxiliary elements, respectively.

6 Claims, 4 Drawing Figures

APPARATUS FOR DISTRIBUTING PRESSURIZED FLUID TO A MULTI-ELEMENT WEFT INSERTER

BACKGROUND OF THE INVENTION

The invention relates to fluid-jet weaving machines and more particularly to apparatus within such machines for distributing pressurized fluid to a plurality of auxiliary active elements forming part of the weft insertion apparatus of the weaving machine.

In known distributing arrangements of this type, a plurality of successively operated, cam-controlled spring valves having operating pistons therein are employed to couple air or other pressurized fluid to the successive active elements in the insertion apparatus. The timing of operation of the successive valves is so chosen as to collectively form a progressively moving pressure wave along the shed, thereby augmenting the propelling effect of the main insertion nozzle of the machine.

Unfortunately, such cam-controlled systems of spring valves are highly susceptible to seizure and malfunction, and in addition are complicated and expensive to construct and maintain. In addition, with such arrangements it is often necessary to provide extended conduits between the valves and the associated auxiliary inserter elements, which not only consumes needed space but also deleteriously effects the shape and amplitude of the pressure pulses distributed to the weft insertion system.

SUMMARY OF THE INVENTION

Such disadvantages are overcome with the pressure fluid distributor of the present invention. In an illustrative embodiment, a simply constructed fluid distributing cylinder is employed, such cylinder being supported for rotation in a breast beam or other fixed portion of the fluid-jet loom. The distributing cylinder is provided with a plurality of peripheral openings that are successively distributed axially and circumferentially around the cylinder periphery between first and second ends of the cylinder.

A plurality of two-part valves are individually associated with the peripheral openings on the cylinder. In particular, each valve includes a first portion secured to the cylinder periphery, such first portion having a fluid conduit communicating at its inlet end with the periphery opening. The valve also has a second apertured portion that is urged by a spring against the outlet end of the first portion, such second portion having a fluid conduit that provides communication between an arcuate outlet slot of the first portion and a conduit extending to the associated one of the auxiliary inserter elements in cyclic fashion during the rotation of the cylinder. Because of the axial and circumferential staggering of the peripheral openings, the successive valves feed the associated weft insertion elements in successive fashion to provide the desired pressure wave through the loom shed.

Advantageously, the relatively high fluid pressure required for the main nozzle of the loom and the relatively low pressure required for the auxiliary insertion elements of the loom may be accommodated by the cylinder and valve construction just described. For this purpose, a baffle member may be positioned within the cylinder to divide such cylinder into mutually isolated regions, with the high pressure for the main nozzle being supplied through the first end of the cylinder into the first region, and with the low pressure required for the auxiliary elements fed through the second end of the cylinder into the second region. Illustratively, one of the peripheral openings in the cylinder, with its associated valve structure, is associated with the main region, while the remaining openings and valve members are associated with the second region.

BRIEF DESCRIPTION OF THE DRAWING

The invention is further set forth in the following detailed description taken in conjunction with the appended drawing, in which.

DETAILED DESCRIPTION

Figure 1:
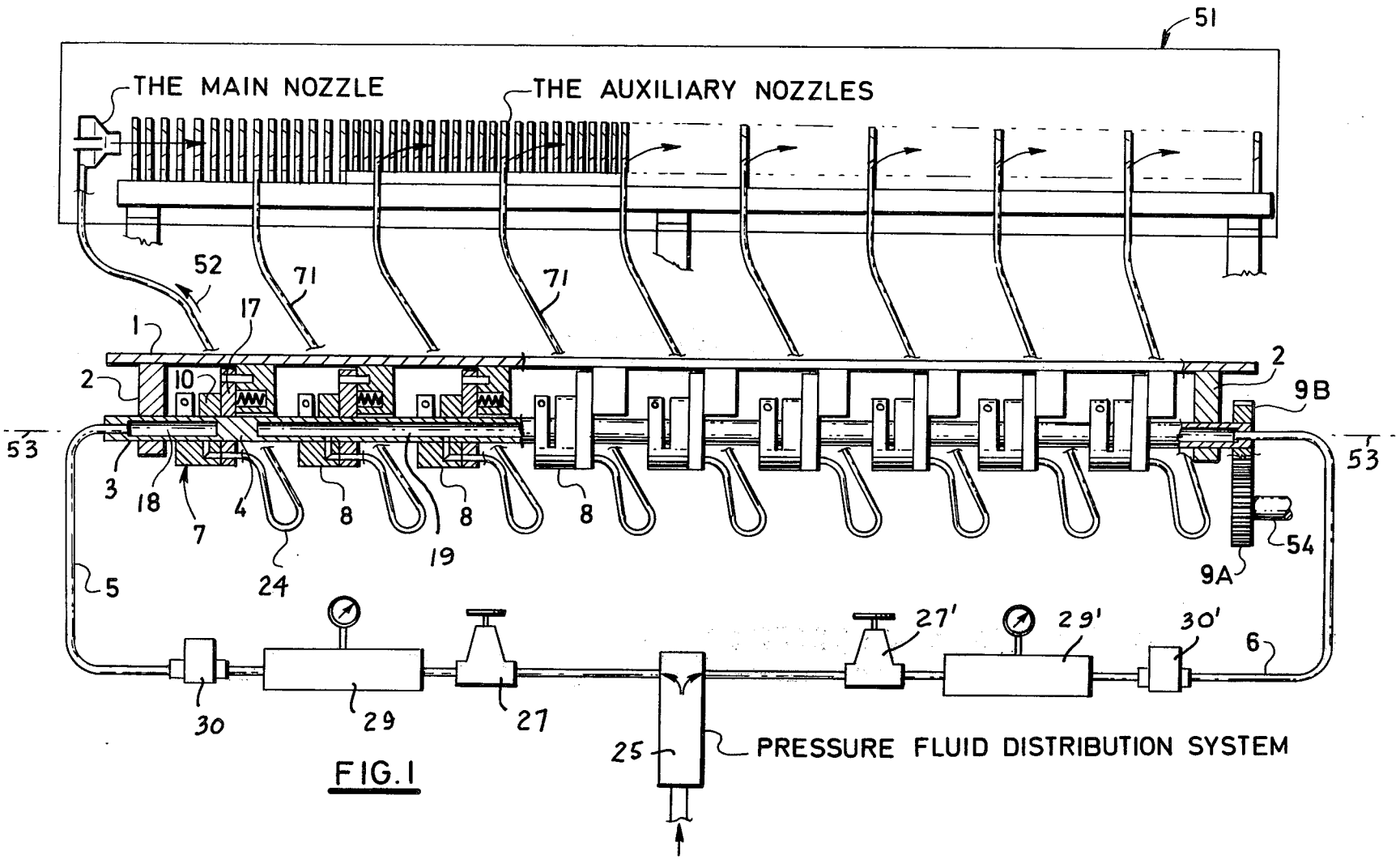
FIG. 1 is an axial view, partially in elevation and partially in longitudinal section, schematically showing the main nozzle and the auxiliary nozzles of a fluid-jet loom, a pressurized fluid distributing mechanism constructed in accordance with the invention, and a pressurized fluid distribution system.

Referring now to the drawing, there are illustrated certain portions of a conventional fluid-jet loom including a fixed breast beam 1 and a weft insertion section 51. The section 51, which forms no part of the invention, has a plurality of fluid inlet fittings which are respectively associated with a main nozzle and with a plurality of auxiliary nozzles, such nozzles cooperating to establish what is essentially a travelling pressure wave through the shed of the loom for the insertion of the weft.

The weft insertion system 51 is composed of an insertion channel having a plurality of separated plates, and weft insertion nozzles. Such plates constitute a continuous channel through which the weft thread is transported. The main nozzle, which serves to give the weft thread inserting impulse, is located at the entry into the inserting channel, while the auxiliary nozzles, which transport the weft thread through the channel, are distributed along the length of the channel in such a way as to produce a weft supporting wave of successively discharged pressurized fluid. Such combination of elements is best shown in FIG. 1. The section 51 is conventional in the art, being shown by the U.S. Pats. to SVATY ET AL No. 3,821,972 and to VERMEULEN No. 3,705,608, French Pat. to SCHEFFEL No. 2,212,455, as well as the German Pat. to HORTMANN No. 1,535,454.

The breast beam 1 carries a pair of end supports 2, in which are disposed bearings (not shown) for rotatably supporting the ends of a fluid distributing cylinder 3 extending along a central axis 53. The cylinder 3 is rotatably coupled to a main driveshaft 54 of the loom by a conventional drive coupling represented by gears 9*a*, 9*b*.

Figure 4:
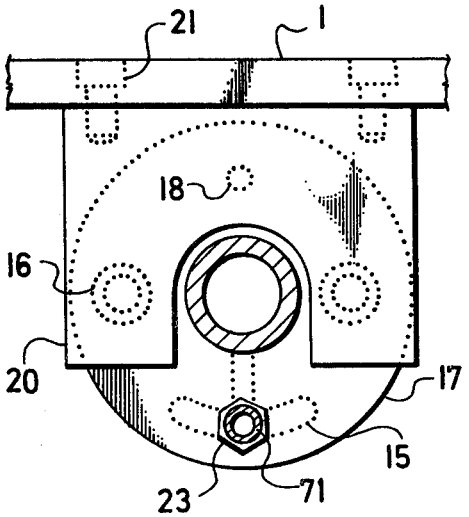
FIG. 4 is a view in end elevation of the valve member shown in FIGS. 1 and 2, the view being taken from the line 4—4 in FIG. 2 in the direction of the arrows.

A plurality of peripheral openings 13 (FIG. 2) are successively disposed longitudinally and circumferentially on the periphery of the cylinder 3 between a first end 61 and a second end 62 thereof. Two of such successively disposed openings 13 are illustrated in FIG. 4. The number of openings 13 illustratively correspond to the number of fluid fittings of the weft insertion section 51.

A plurality of two-part valves 7 are individually associated with the openings 13 of the cylinder periphery. As indicated below, each valve 7 is adapted to cyclically and successively connect the successive openings 13 on the cylinder periphery to an appropriate one of the fluid fittings of the insertion system 51, whereby fluid introduced into the interior of the cylinder 51, may be cyclically distributed to the main nozzle and to the auxiliary nozzles of the section 51 to establish the desired travelling pressure wave for propelling a weft thread forwardly through the loom shed. For this purpose, a plurality of conduits 71 extend from the outputs of the respective valves 7 to the associated fluid fittings.

Figure 2:
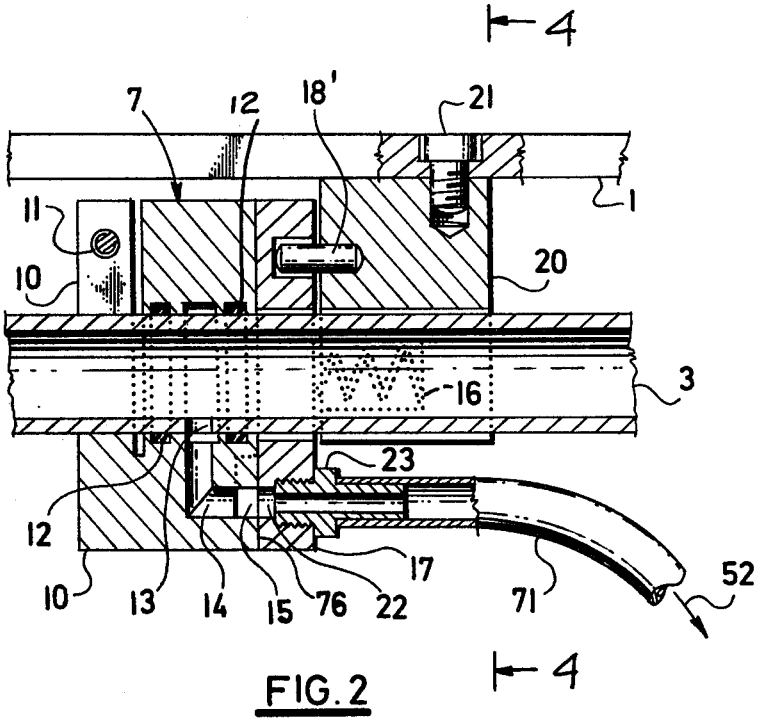
FIG. 2 is an enlarged, fragmentary axial view of a portion of the arrangement of FIG. 1, illustrating the valve construction thereof in detail.
Figure 3:
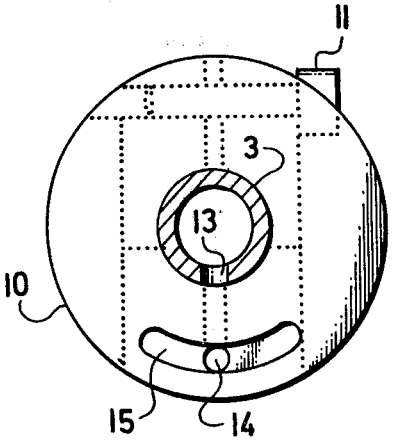
FIG. 3 is an end view of a first apertured portion of the valve member illustrated in FIG. 1.

The construction of the valves 7 is shown best in FIG. 2. A first apertured valve portion 10 is in the form of a sleeve disposed in surrounding relation to the periphery of the cylinder 3, the sleeve 10 having a fluid conduit 14 whose inlet end is aligned to communicate with the interior of the cylinder 3 through the associated one of the openings 13 as shown. The outlet end of the conduit 14, which is accessible through an end surface 76 of the sleeve 10, is widened out as shown in FIG. 3 into an arcuate slot 15 that extends concentric with the axis 53. The sleeve 10 is secured to the cylinder 3 as by screws 11.

Pressurized fluid is supplied from a source (not shown) to the central part 25 of the pressure fluid distribution system shown in FIG. 1. The cylinder 3 is generally in the form of a tube, the passage within such tube being interrupted by a baffle or plug 4 so as to form a chamber 18 at the left-hand end of cylinder 3 as it is shown in FIG. 1*a* and a second channel 19 throughout the remainder of the cylinder. The baffle or plug 4 isolates chambers 18 and 19 from each other. The chamber 18 is fed from the central part 25 of the pressure fluid distribution system through a left branch which has serially interposed therein a pressure reducing valve 27, an air chamber 29, and an electrically operated valve 30, there being a conduit 5 extending from valve 30 to the left-hand end of the cylinder 3 and communicating with the chamber 18. From the central part 25 of the pressure fluid distribution system there extends a right-hand bridge having interposed therein a pressure reducing valve 27', an air chamber 29', and an electrically operated valve 30'. Pressurized fluid is fed through the valve 30' into a conduit 6 which is connected to the right-hand end of the cylinder 3, and thus to the chamber 19.

The valve 27 is adjusted to feed fluid to chamber 18 at a pressure reduced to a value suitable for the main nozzle, while the valve 27' reduces fluid pressure to that required for the auxiliary nozzles.

The sleeves 10 of each of the valves 27 are so arranged on the cylinder 3 that the annular groove machined in each sleeve connects with a respective opening 13 on the cylinder. Annular grooves on either side of groove 13 contain rubber or rubber-like sealing rings 12.

The pressurized fluid coming from the pressure fluid distribution system is led through the tubes 5 and 6 and proceeds through the left chamber 18 and the right chamber 19 within the cylinder 3, respectively, and then proceeds through the openings 13 and the annular grooves into the conduits 14 (FIG. 2). When the rotation of the sleeve 10 causes the slot 15 to confront the inlet 22, pressurized fluid enters into the tube 24 and is then led freely to the main nozzle, or to the auxiliary nozzles through tubes 71, as the case may be. When the slot 15 turns a little further and passes the inlet 22, the face of the sleeve 10 covers the inlet 22 and shuts off the passage of fluid into the tube 24 or the tubes 71.

Each valve element 7 further includes a second apertured portion 17 which cooperates with the sleeve 10, the portion 17 being in the form of a sleeve which is carried on cylinder 3 but prevented from rotation therewith by a pin 18' affixed to and projecting from an abutment member 20, which in turn is secured to the breast beam 1. The portion 17 is axially movable with respect to the cylinder 3 and the pin 18', and is biased against the end surface 76 of the sleeve 10 by means of a spring 16 carried on the member 20.

The member 17 has a fluid conduit 22 extending therethrough, with the inlet end of such conduit radially positioned so as to be sequentially in abutting and communicating with the outlet slot 15 of the first conduit 14 on the sleeve 10. A screw fitting 23 is affixed to the outlet end of the member 17 for providing communication between the conduit 22 and the conduit 71 leading to the appropriate fitting on the weft insertion section 51.

The portion 17 is loosely mounted on the cylinder 3, being axially movable on the pin 18'. The pin 18' serves to center the portion 17 on the cylinder, and simultaneously prevents its turning relative thereto so that the inlet 22 is permanently kept in its angular position on the cylinder 3. The thrusting means of coil compression spring means 16 serves to force the face of the portion 17 against the face of the sleeve 10, and thus to secure a fluid-tight fit between the slot 15 and the inlet 22.

With such arrangement, a rotation of the cylinder 3 about its axis 53 will cyclically bring the conduits 14 and 22 in the valve elements 10 and 17, respectively, into registration at a specified time during each such cycle of rotation. During such registration, pressurized fluid within the cylinder 3 will be applied to the appropriate fitting via the peripheral opening 13, the first conduit 14, the second conduit 22, the screw fitting 23 and the conduit 71.

It will be understood that as the cylinder continues to rotate, the next successive valve on the cylinder will be opened in the same manner to apply fluid to the next-succeeding pressure fitting of the weft insertion section 51, etc.

As best shown in FIG. 1, a relatively high pressure fluid is introduced via the hose 5 into the left-hand chamber 18 of the cylinder 3 to be applied to the main nozzle of the weft insertion section 51, the fluid flowing to such nozzle in the direction 52 (FIGS. 1 and 2). In like manner, a relatively low pressure fluid is introduced via the hose 6 into the right-hand chamber 19 in the cylinder 3 to be applied to the auxiliary nozzles of the inserter section 51. In order to isolate such flows of fluid at different pressures, a baffle or plug member 4 is disposed within the cylinder 3 downstream (as viewed in the direction of flow of fluid from the hose 5) of the first opening 13 associated with the main nozzle of the insertion section 51. Such expedient permits a common cylinder to be employed for the distribution of fluid to all of the active parts of the insertion section.

In the foregoing, an illustrative arrangement of the invention has been described. Many variations and modifications will now occur to those skilled in the art. It is accordingly desired that the scope of the appended claims not be limited to the specific disclosure herein contained.

What is claimed:

1. In a fluid-jet weaving machine, an apparatus for distributing pressurized fluid to a multi-element weft insertion section associated with the machine, the apparatus comprising, in combination, an elongated frame, a distributing cylinder supported for rotation in the frame, the cylinder having a longitudinal axis and first and second opposed ends, the cylinder further having a plurality of first peripheral openings therein extending in axially spaced relation between the first and second ends, a plurality of valve means individually associated with the periphery of the cylinder for selectively coupling fluid from the interior of the cylinder to an associated one of the elements in the weft insertion apparatus via the peripheral openings in the cylinder, each valve means having a first apertured portion supported by the cylinder and having a first fluid conduit therein communicating at its inlet end with the associated one of the first peripheral openings on the cylinder, each valve means further having a second apertured portion supported by the frame adjacent an associated one of the first portions, said second portion having a second fluid conduit whose inlet end cyclically communicates with the outlet end of the first conduit in the first portion during a rotation of the cylinder in the frame, first means for introducing pressurized fluid into the first end of the cylinder, and means for rotating the cylinder about its longitudinal axis within the frame.

2. Apparatus as defined in claim 1, further comprising means carried by the frame for resiliently urging the second portion of each valve means against the associated first portion.

3. Apparatus as defined in claim 1, in which the outlet portion of each first conduit is in the form of an arcuate slot concentric with the first axis.

4. Apparatus as defined in claim 1, in which successive ones of the first peripheral openings on the cylinder are successively spaced circumferentially around the periphery of the cylinder.

5. Apparatus as defined in claim 1, further comprising means disposed in the cylinder for dividing the interior of the cylinder into mutually isolated first and second chambers, the first chamber being bounded by the first end of the cylinder and including at least one of the first peripheral openings, the second chamber including the second end of the cylinder and the remainder of the first peripheral openings.

6. Apparatus as defined in claim 5, further comprising second means for introducing pressurized fluid into the second end of the cylinder.

* * * * *